US008136698B1

(12) United States Patent
Beaulieu

(10) Patent No.: US 8,136,698 B1
(45) Date of Patent: Mar. 20, 2012

(54) APPLICATOR FOR THE DELIVERY OF SOLUTIONS AND MATERIALS IN A PRESSURIZED FLUID SYSTEM

(76) Inventor: Michael Sylvius Beaulieu, New Haven, CT (US)

( * ) Notice: Subject to any disclaimer, the term of this patent is extended or adjusted under 35 U.S.C. 154(b) by 113 days.

(21) Appl. No.: 12/562,393

(22) Filed: Sep. 18, 2009

Related U.S. Application Data

(60) Provisional application No. 61/199,890, filed on Nov. 21, 2008.

(51) Int. Cl.
*B05B 7/12* (2006.01)

(52) U.S. Cl. ..... 222/94; 222/386.5; 222/105; 222/132; 222/387; 222/325; 222/389; 239/304; 239/310; 239/407

(58) Field of Classification Search ..... 222/94–96, 222/105, 132, 135, 144.5, 145.1, 145.5–145.7, 222/325, 386.5, 389, 387; 239/304, 305, 239/310, 313, 407
See application file for complete search history.

(56) References Cited

U.S. PATENT DOCUMENTS

| | | | | |
|---|---|---|---|---|
| 2,708,600 | A * | 5/1955 | Froidevaux | 239/319 |
| 3,198,438 | A | 8/1965 | Hultgren | |
| 4,192,464 | A | 3/1980 | Chow | |
| 4,382,552 | A | 5/1983 | Lubsen et al. | |
| 4,406,406 | A | 9/1983 | Knapp | |
| 4,418,869 | A | 12/1983 | Healy | |
| 4,491,254 | A | 1/1985 | Viets et al. | |
| 4,854,482 | A | 8/1989 | Bergner | |
| 4,875,626 | A * | 10/1989 | Buhler et al. | 239/314 |
| 5,094,269 | A | 3/1992 | Agulia | |
| 5,273,190 | A | 12/1993 | Lund | |
| 5,511,693 | A * | 4/1996 | Weissman et al. | 222/1 |
| 5,810,211 | A | 9/1998 | Shanklin et al. | |
| 5,899,362 | A | 5/1999 | Moran | |
| 6,415,956 | B1 | 7/2002 | Havlovitz | |
| 7,156,324 | B2 | 1/2007 | Birrenkott et al. | |
| 7,311,265 | B2 | 12/2007 | Bhatia | |
| 2005/0263613 | A1 | 12/2005 | Beck et al. | |
| 2007/0075099 | A1 | 4/2007 | Hornsby et al. | |
| 2007/0131794 | A1 | 6/2007 | Lai et al. | |

FOREIGN PATENT DOCUMENTS

| | | |
|---|---|---|
| KR | 1019990081999 | 11/1999 |
| KR | 1020010020200 | 3/2001 |

* cited by examiner

*Primary Examiner* — J. Casimer Jacyna
(74) *Attorney, Agent, or Firm* — DeLio & Peterson, LLC; Robert Curcio, Esq.

(57) ABSTRACT

A hand holdable applicator for delivering solutions and materials in a pressurized fluid system. Additives of solutions or materials are contained in replaceable, collapsible cartridges or liners, responsive and compressible to external fluid pressure regulated by the operator. Upon compression, additives combine with variably controlled fluid ingress and are mixed before dispersing through a nozzle having varying spraying configurations. The applicator may hold a plurality of cartridges, and additives may be administered separately or in combination.

6 Claims, 8 Drawing Sheets

APPLICATOR FOR THE DELIVERY OF SOLUTIONS AND MATERIALS IN A PRESSURIZED FLUID SYSTEM

CROSS REFERENCED TO RELATED APPLICATION

This is a non-provisional patent application that claims priority to and the benefit of provisional patent application U.S. Ser. No. 61/199,890 filed on Nov. 21, 2008, entitled "A MULTIFUNCTIONAL HAND HOLD-ABLE GARDEN HOSE ATTACHMENT FOR DISPENSING MULTIPLE SOLUTIONS IN FLEXIBLE CARTRIDGES," which is incorporated herein by reference in its entirety.

BACKGROUND OF THE INVENTION

1. Field of the Invention

The present invention relates generally to a hand-holdable applicator or sprayer, specifically, a multi-functional single reservoir mechanical applicator for delivering under pressure a plurality of selected enrichments either singularly or in combination, and more specifically for a hose applicator for delivering a plurality of additives in operator regulated amounts to an outgoing stream of water.

2. Description of Related Art

Today's industry standard for most hose applicators works using principles incorporating Venturi design technology. For example, using a garden hose applicator to apply additives is typically performed by manipulating the speed of a stream of water to create a vacuum that draws and simultaneously mixes additives, such as liquid chemicals, with water. The incoming water stream is generally restricted by a nozzle, while the speed of the outgoing water is a function of the inverted funnel shape at the bottom of the Venturi design. The resultant vacuum attracts the additives to the water stream.

For most spraying garden hose attachments, the amount of chemical introduced to the flow stream is regulated by interchangeable metering tips that restrict chemical flow into the water. These devices work principally from the vacuum created by ordinary water line pressure available in most homes.

The household and industrial products that are most commonly sold for hose attachment sprayers include: cleansers, fertilizers, herbicides, insecticides, polishes, and waxes. These applications may also impose environmental concerns in that a user may come in contact with, and may ultimately be exposed to, the added product when using or refilling the device, and depending upon the additive, spills can be environmentally hazardous.

There are many different kinds of hose attachment applicators and sprayers that can be connected to a pressurized water system. One prior art attachment sprayer is a trigger operated plastic vessel with a removable threaded cap allowing entrance into the vessel for replacing a granular product. Water entering the tank or reservoir through a small aperture in the bottom portion of the cap comes in contact with and dilutes the contents inside the vessel, where it mixes with a stream of water as it approaches the end nozzle. One advantage of such applicators is that they are inexpensive and easy to use. The disadvantages include dispersing product in limited, unsustainable pulses, not delivering product in consistent, controlled amounts, lacking pressure, and leaking. Additionally, these applicators can only deliver one additive at a time, and must be held in a vertical or otherwise singularly defined position to function properly.

An example of a hose attachment sprayer with an ordinary plastic bottle having a connection for a hose attachment positioned at the top is depicted in two prior art designs, specifically in U.S. Pat. No. 4,491,254 issued to Alan K. Viets, et al., on Jan. 1, 1985, entitled "LIQUID CHEMICAL APPLICATOR," and U.S. Pat. No. 4,382,552 issued to Lubsen, et al., on May 10, 1983, entitled "LIQUID APPLICATOR." The top of a Venturi functional device may have an off/on control valve to regulate the dispensing of the contents and water egress from the end nozzle positioned in front of where the device attaches to a hose. One disadvantage of these devices is the lack of pressure, which translates into dispersing only small amounts of product. Consequently, the length of time that these devices operate would not be suitable for industrial applications. Moreover, neither of these inventions is designed for administering a plurality of additives singularly or in combination at the operator's discretion.

Another popular applicator is the air pump sprayer as disclosed in U.S. Pat. No. 4,192,464 issued to Chow on Mar. 11, 1980, entitled "COMPRESSED AIR SPRAYER." The air pump spray container has a hand-operated air pump attachment for pressurizing the container with compressed air to dispense product through an egress tube connected to an adjustable nozzle end. When pressurized, the Chow design operates similar to a disposable aerosol can in that it loses power with declining vessel pressure. One disadvantage of the air pump sprayer is that it demands considerable effort to keep charged because of its limited capacity for pressurization. It loses pressurization quickly, reducing the flow volume, and shortening the distance of the stream of product issuing the nozzle end. Another disadvantage is that it is not designed for the application of multiple additives.

Another type of sprayer is the spring biased sustained duration pump, similar to the type identified in U.S. Pat. No. 5,810,211, issued to Shanklin, et al., on Sep. 22, 1998, entitled "PUMP ASSEMBLY WITH SLIDING PLUG." Like the popular air pump, spring operated sprayers provided a pump handle mechanism for pressurizing the vessel, except the spring biased pump does not utilize pressurized air to deliver liquid from the container out the nozzle end. Instead, a spring biased piston is located inside a cylinder where it connects to a rod that extends through the spring, and eventually out of the container terminating with a handle. When the handle is activated, the piston is moved through the cylinder against the spring, drawing liquid from the container into the cylinder through a one-way inlet valve. When the handle is released, the spring exerts force against the piston which pressurizes the liquid in the cylinder. Pressure built up in the cylinder reservoir forces the liquid through a one-way outlet valve into the tube to the issuing spray head which has a spray valve to control dispensing of the liquid. When the spray valve is opened, liquid under pressure flows from the cylinder through a tube to the spray valve, and out a nozzle on the handheld sprayer. When the spring returns the piston to the starting position, the sustained continuous spray ceases and the pump must be primed again. The spring biased sustained duration pump must rest on a solid flat surface, usually held down with one hand while the pump is primed with the other. This is not a sound ergonomic design. Furthermore, the large pump cylinder inside the fluid container is another disadvantage in that it takes up sufficient space, which accounts for the size and the weight of the container, generally on the order of five (5) liters for holding fluid. Another drawback is that the piston rod extends out of the container when the pump is primed. The protruding appendage is awkward and invites a potentially hazardous disadvantage.

In U.S. Pat. No. 3,198,438, issued to Hultgren, et al., on Aug. 3, 1965, entitled, "SPRAYER CONSTRUCTION," a sprayer is taught wherein the additive or chemical being mixed with a water stream is contained in a disposable collapsible container having an aspirating tube extending into the water stream. The water stream applies pressure to the outer surface of the collapsible container to force a liquid additive through the aspirating tube into the water stream. Importantly, Hultgren's design does not regulate the water pressure to the additive, which would adjust the amount of additive being delivered by the water stream. Additionally, Hultgren does not provide for a plurality of additives that may be administered either singularly or in combination under operator control at varying amounts.

Yet another hand holdable spring biased spray pump exists, where the pump mechanism is in a handheld wand rather than the hollow liquid holding container. One example is found in U.S. Pat. No. 6,415,956 issued to Havlovitz on Jul. 9, 2002, entitled "HAND HOLDABLE PUMP SPRAY APPARATUS." To pressurize the system, the holding vessel usually is placed on a flat sturdy surface, while the operator holds the spray apparatus housing in one hand and pulls the handle outward from its hand holdable housing were a liquid is drawn into the main chamber, simultaneous with coil spring compression. The main chamber is filled with dispensing liquid when the coil spring is fully compressed. To activate the system the operator pulls back on the trigger mechanism, allowing pressurized liquid to flow through a passage issuing the adjustable nozzle end. The piston rod must be repeatedly pulled out from its housing in order to recharge and prime the device for the short duration it operates. The enrichments issuing the nozzle end are dispersed without significant power, and their volume is limited. The awkwardness of the piston extension rod and long flexible extension tube connected to the handgrip and vessel imposes safety concerns during normal operation. Additionally, normally these disposable containers are not refillable or recyclable and impose yet another environmentally hazardous disadvantage.

In U.S. Pat. No. 7,156,324 issued to Birrenkott, et al., on Jan. 2, 2007, entitled "SPRAYING DEVICE WITH INTERCHANGEABLE CARTRIDGE," a removable bottle connects to the body of a sprayer for delivering enrichments, whereas the sprayer is attached at an end opposite the enrichment bottle connection. The singular additive discharges from the bottle through the sprayer. The design of the apparatus includes a hand holdable pistol grip with a connection at the bottom for a hose attachment. Where the hose attaches to the bottom of the handgrip there is a back flow pressure valve that prevents the forces of gravity from allowing water and the enrichments in the bottle to return to the hose when the apparatus is not in use while still connected to a pressurized water system. A disadvantage of this apparatus is that the functionality and principles of fluid or liquids issuing the component are not much better than its predecessors, utilizing the forces of gravity and Venturi vacuum technology to control, manipulate, and deliver product enrichments through a larger fluid channel egress from the nozzle end of the spraying apparatus. Still another disadvantage of this type of spraying device is the singularity of the enrichments component that is combined with water issuing the nozzle end. The singular contents of the enrichment bottle dictates one specific application, and the manner in which it issues the nozzle end limits its range both commercially and industrially. The Birrenkott invention relies on the forces of gravity to dispense fluid out of a spraying nozzle head at the end of the apparatus. Additionally, the Birrenkott invention employs large disposable containers or bottles that must be changed periodically and are not environmentally friendly.

As noted, a majority of these devices work only when they are handheld by the operator in a position where the dip tube inside the container remains in a substantially vertical position. Importantly, to function properly, the end of the dip tube nearest the bottom of the container must always be submerged in liquid to draw the contents in the container into the dip tube and ultimately out an egress nozzle end using the principles of Venturi vacuum as well as gravity to dispense fluids.

SUMMARY OF THE INVENTION

It is therefore an object of the present invention to provide embodiments for applicators that overcome the disadvantages of the prior art, whereby providing a sustained duration spraying device with a single reservoir that can be pressurized, preferably with a pressurized water system that attaches to a garden hose.

It is a further object of the present invention to provide an applicator having an improved hand holdable handgrip section with an inlet passage that accommodates multiple fluid communicating passages for simultaneous or selected egress, controlled by a switch that substantially regulates and monitors the water pressure inside the vessel to control the predetermined flow and volume of water entering and issuing the vessel for singularly or plurality dispensing of enrichments.

Another object of the present invention is to provide an applicator having a plurality of additives or enrichments contained in separately sealed flexible replaceable cartridges responsive to ingress fluid pressure for individual or collective dispersing.

Another object of the present invention is to have a rotational fluid control switch to regulate the water pressure, flow rates, and volume of water ingress.

It is a further object of the present invention to provide an embodiment that includes a substantially improved switch component in fluid communication with a second water passageway inside the handgrip to linearly direct and regulate water flow away from the egress end, which pressurizes the vessel and regulates the fluid flow or propulsion of selected enrichments and materials inside the vessel.

Still yet, a further object of the present invention is to independently regulate the manual dispensing of alternatively selected enrichments inside the vessel.

Another object of the present invention is to provide an embodiment for an improved, submergible, watertight, and waterproof vessel, whereby the functionality of the apparatus does not operate or depend upon the dynamics and principles of gravity or Venturi design for dispensing fluids and additives from a vessel.

It is yet a further object of the present invention to provide an embodiment whereby a multi-functional waterproof, rotational fluid control switch is used to substantially approximate the predetermined pressurization of the interior of the vessel.

It is a further object of the present invention to provide an embodiment having an improved single reservoir multifunctional, environmentally friendly, sustained duration mechanical applicator with replaceable additive cartridges, whereby the device accommodates a power compressor in addition to or in replacement of a high pressure water system.

The above and other objects, which will be apparent to those skilled in the art, are achieved in the present invention, which is directed to an applicator for dispensing at least one additive in a fluid system comprising: a vessel having a first portion for receiving fluid under pressure, and a second portion for mixing and dispensing the at least one additive; at least one cartridge in the first portion of the vessel, and in fluid communication with the fluid, the at least one cartridge containing the at least one additive and collapsively responsive to an increase in externally applied pressure from the fluid, such that when the at least one cartridge is subjected to the externally applied pressure, the at least one cartridge compresses, dispensing the at least one additive from the first portion of the vessel to the second portion of the vessel; a primary fluid channel in the second portion of the vessel in fluid communication with the at least one cartridge and the fluid, receiving the at least one additive upon compression of the at least one cartridge, combining the fluid and the at least one additive; a variable switch or valve for regulating the introduction of the at least one additive to the primary fluid channel allowing an operator to mix different additives in various amounts when more than one additive is present; a variable switch or valve for regulating egress fluid from the vessel; a variable switch or valve for regulating ingress fluid pressure on the at least one cartridge; and a nozzle in fluid communication with the primary fluid channel receiving and dispensing the combined fluid and the at least one additive.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiments of the present invention, reference will be made herein to FIGS. 1-7 of the drawings in which like numerals refer to like features of the invention, with the understanding that the present disclosure is to be considered as an exemplification of the invention, and is not intended to limit the invention to the specific embodiments illustrated.

Figure 1:
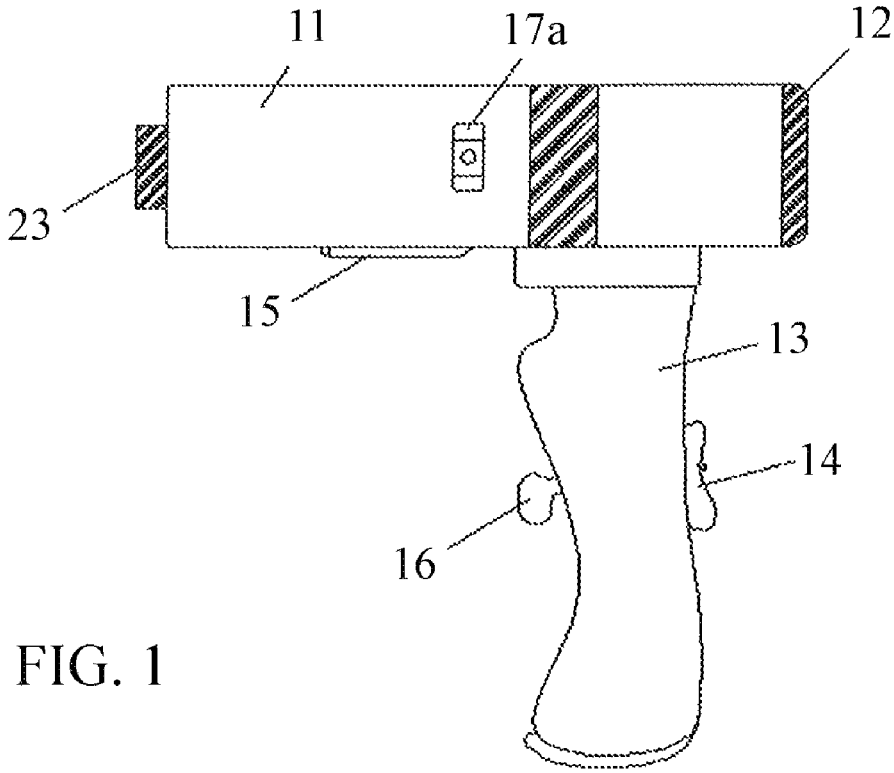
FIG. 1 is a perspective side view of the applicator body with a hand holdable handgrip.

Referring to FIG. 1, the preferred embodiment includes, a hand holdable applicator 10 having a cylindrical body or vessel 11 with end cap 12 at one end. Preferably, end cap 12 is threaded and detachably connected to body 11. End cap 12 makes a sealed connection with body 11, and prevents pressurized fluids within body 11 from undesirably leaking out. Body 11 is supported by a hand holdable handgrip 13 joined to the bottom of body 11. A variable actuating lever, switch, valve, or trigger 16 is supported on handgrip 13 for initiating fluid egress out of an adjustable applicator nozzle head 23 located at the end of body 11 opposite end cap 12. Optionally, an illuminated fluid control switch or valve 15 may be mounted on applicator 10. Fluid control switches or valves 17 are located on opposite sides of vessel 11, each dedicated for engaging internal, replaceable, collapsible liners, cartridges, or bags 26*a*, 26*b* that disperse additives into the fluid egress stream. Each liner, cartridge, or bag 26 is a thin, airtight, lightweight, collapsible sealed container that is responsive to external forces, and delivers the additives when subjected to external pressure. A modifiable LED illumination system 15 may be attached to vessel 11, preferably to the undersurface of the forward half of vessel 11. A rotational fluid control valve 14 is located on handgrip 13, preferably located opposite trigger 16.

In one embodiment, cartridge 26 is a combination of a light weight rigid cylinder having apertures for fluid ingress, and a sealed disposable, compressible liner that contains a product or additive, such as, but not limited to, soap, wax, liquid fertilizer or weed control, to name a few. When vessel 11 is under pressure, force is exerted on the thin liner and squeezes or compresses the product into a fluid channel connected to the liner.

Figure 2:
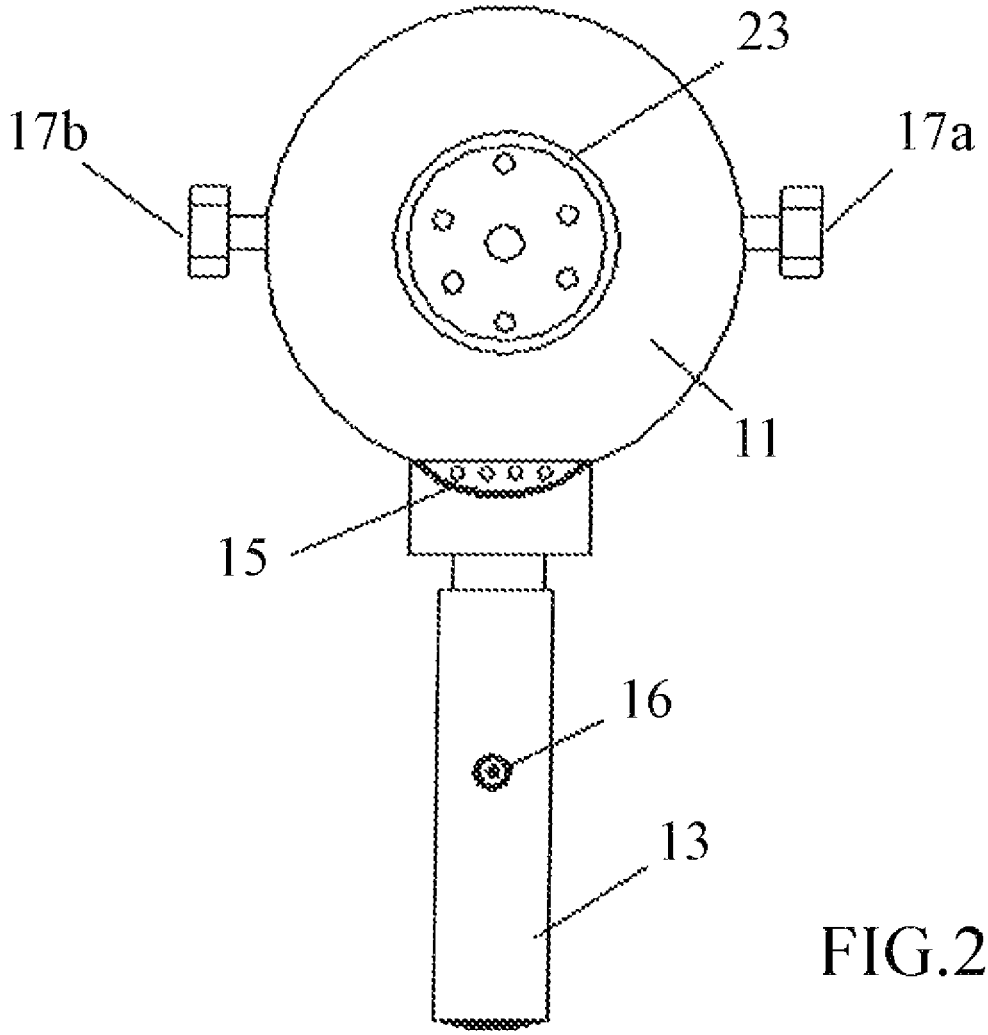
FIG. 2 is a perspective close-up view of the front of the applicator of FIG. 1.

As depicted in FIG. 2, a perspective view of the front section of applicator 10 is shown. Two exemplary enrichment control switches 17*a*, 17*b* for dispensing additives or enrichments are shown; however more may be used depending upon the number of additive liners, cartridges, or bags 26 (for simplicity, hereinafter referred to as cartridges) used in vessel 11. These switches are depicted as being manually driven, although the instant invention is not limited to semi-automatic or automatic implementations. Preferably, the additives or enrichments are fluid in nature, but may also be fine particles capable of releasing upon applied pressure within vessel 11. Enrichment control switches 17*a*, 17*b* may include a valve knob for approximately rotatably selecting between various delivery conditions, such as: off, on, low, medium, high, and fluid only, during engagement with additive cartridges 26*a*, 26*b*. Enrichment control switches 17*a*, 17*b* are coupled to valves 29*a*, 29*b* that engage cartridges 26*a*, 26*b*. An actuating lever or trigger mechanism 16 is orientated at the front of handgrip 13, approximately centered, for substantially controlling fluids entering and issuing vessel 11 at predetermined rates.

Enrichment control switches 17*a*, 17*b* substantially control the singularity and plurality of the discharging of the elements or additives from multiple cartridges 26*a*, 26*b* inside the rear compartment. The switches allow for additives to combine with pressurized fluid that ultimately issues the adjustable applicator head nozzle 23.

Cartridges 26*a*, 26*b* are exemplary storage containers or light weight, collapsible, disposable thin liners. Each cartridge can hold a different liquid concentrate, such as a solution or fluid, pellets, granules, pastes, or any substance that does not interfere, dissolve, disintegrate, destroy or compromise the integrity or structure of the cartridges for which they are designed for or intended.

In at least one embodiment, attached to the underside of vessel 11 is a water proof LED illumination system 15 to enhance visibility during application. Illumination system 15 may include selecting between four conditions: off, on, low, and high illumination for operation of the applicator in the absence of light or when substantially improving lighting conditions is required. At the front of vessel 11 is adjustable applicator head nozzle 23, which adjusts for different fluid egress configurations, selectable by the user.

Figure 3:
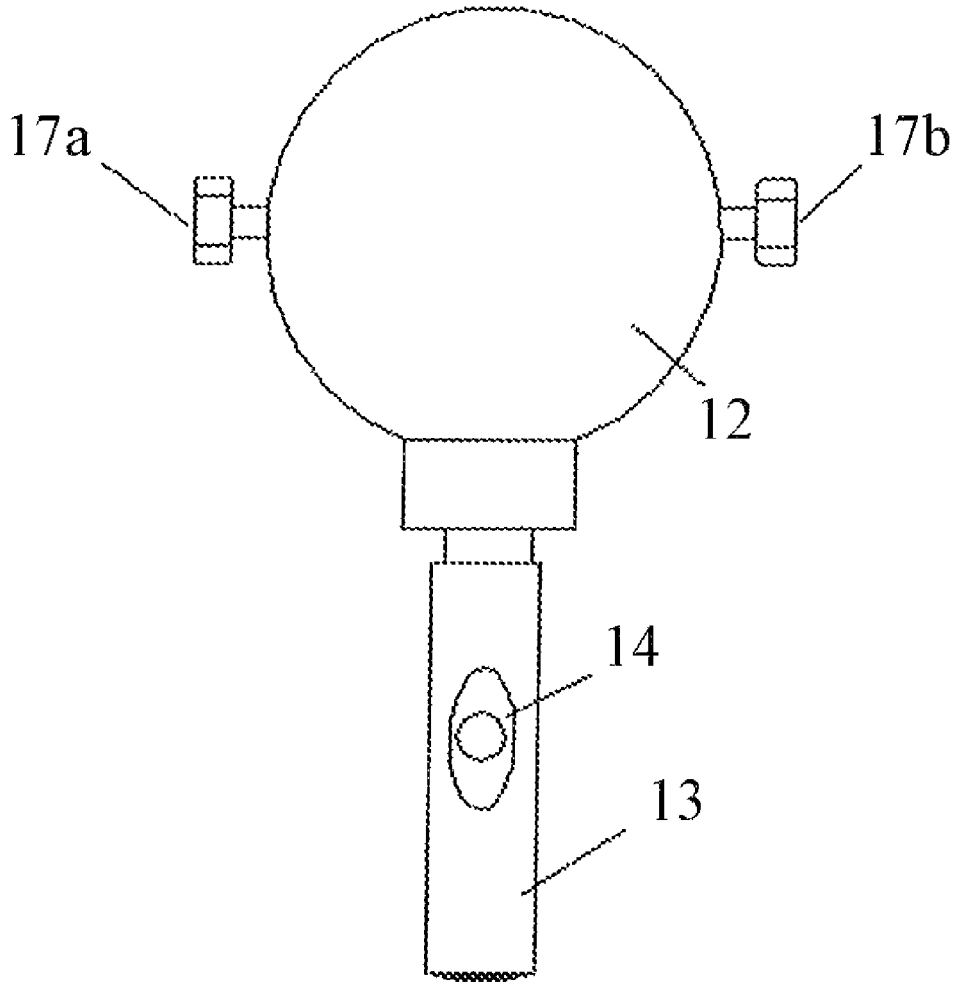
FIG. 3 is a perspective close-up view of the rear of the applicator of FIG. 1.

FIG. 3 is a perspective view of the rear portion of applicator 10. The backside is sealed by the threaded, detachable end cap 12 that allows entry into the rear compartment of vessel 11. By removing end cap 12, the user is able to insert, remove, or replace cartridges containing additives in the body of vessel 11.

A rotational control switch 14 is depicted attached to the approximate center of handgrip 13. Rotational control switch 14 connects to a valve, whereby the position of rotational control switch 14 operates multiple functions regulating the water pressure, flow rates, and volume of water entering the orifice of the valve. Rotational control switch 14 is in fluid communication with the plurality of fluid communicating passages positioned at the end of handgrip 13 that are connected to a coupling that allows for attachment to a high pressure water system, such as a garden hose, or the like. In one embodiment, rotational control switch 14 may be illuminated.

Flow rate for each cartridge or liner may be determined, established, or calibrated separately by water pressure, valve, and nozzle aperture setting, but is not limited to these fundamentals or principles in design as they pertain to the operation and scope of the applicator. This advantage is unlike other devices that are limited in scope by a metered Venturi setting, duck valve, and gravity considerations for singular product applications, or other means of dispensing a product. The flow rate and product volume from each of the cartridges may also be metered separately.

Rotational control switch 14 increases the water pressure inside vessel 11, which exerts greater pressure on cartridges 26*a*, 26*b*, squeezing or compressing more additive product into the fluid channel where the additive mixes with ingress fluid. One may utilize rotational switch 14 in a method to clean valves, channels and other components and features of applicator 10 by allowing higher pressure flow to purge these components.

Figure 4:
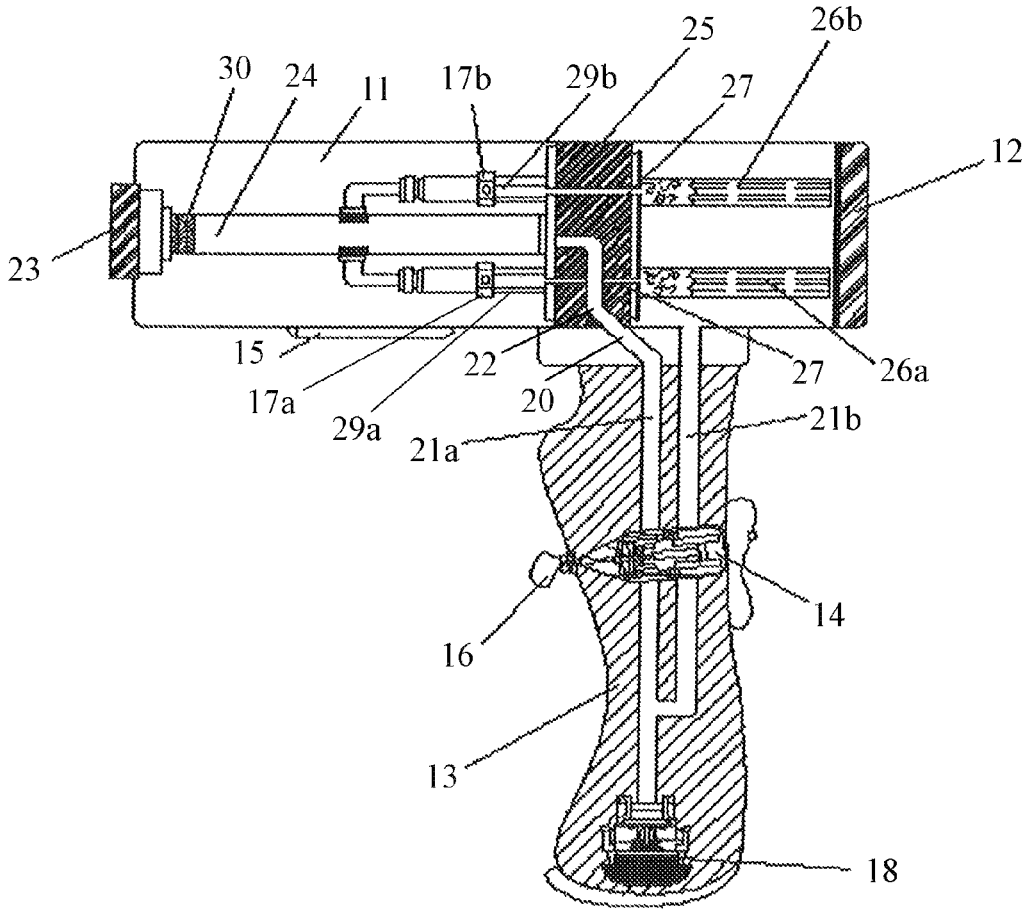
FIG. 4 is a cross-sectional view of the applicator of FIG. 1 depicting internal fluid flow components.

FIG. 4 is a cross-sectional view of applicator 10. A hose attachable coupling 18 is configured at the base of the handgrip 13. Ingress fluid entering vessel 11 will initially enter the base of handgrip 13 through coupling 18, and traverse through fluid channels 21*a*, 21*b*. Ingress fluid will encounter, and be regulated by, rotational control switch 14 within handgrip 13. Fluid channels 21*a*, 21*b* provide different and separate functions for fluids entering and issuing vessel including, but not limited to, the egress fluids and mixtures of enrichments combined and exiting applicator head nozzle 23.

Trigger mechanism 16 acts as a switch to control the rate of flow into vessel 11. When trigger mechanism 16 is open, fluid at a high pressure enters into the fluid channels 21*a*, 21*b*, and vessel 11, at approximately the same rate. When trigger mechanism 16 is closed, fluid is diverted into fluid channel 21*b*.

Importantly, ingress fluid is channeled for two separate functions as controlled by rotational control switch 14. Channel 21*a* directs ingress fluid to applicator head nozzle 23. Ingress fluid traverses through fluid entrance channel 20 to vessel 11, to primary fluid channel 24 where it may be combined with one or more additives from enrichment passage supply lines 28*a*, 28*b*. Although only two enrichment additive passage supply lines are depicted, the invention is not so limited, and may comprise more enrichment passage supply lines to accommodate a plurality of separate and distinct additives. Fluid entrance channel 20 is connected to a fixed partition inside vessel 11 that substantially provides an extension of fluid channel 21*a* to primary fluid channel 24, which forms the channel for fluid egress from applicator 10.

Ingress fluid entering fluid channel 21*b* follows a path to the body chamber of vessel 11. Stationary partition 25, located in vessel 11, confines ingress fluid entering from fluid channel 21*b*. Upon entry through fluid channel 21*b* into the portion of vessel 11 identified by stationary partition 25, flexible, collapsible cartridges 26*a*, 26*b* are subjected to a substantial increase in pressure, which causes them to collapse and force additives towards primary fluid channel 24 through fluid control valves 29*a*, 29*b*. Fluid control valves 29*a*, 29*b* are operated by enrichment control switches 17*a*, 17*b*, respectively. In this manner, one or more additives may be introduced to the egress fluid in primary fluid channel 24 at the operator's discretion.

Manual trigger 16 toggles the fluid entering fluid channels 21*a*, 21*b*, which helps establish the water pressure of vessel 11. Rotational fluid control switch 14 works in tandem with trigger 16 to allow ingress fluid into vessel 11 through channels 21*a*, 21*b*. Ingress fluid in channel 21*b* establishes a high pressure region in the portion of vessel 11 segregated by partition 25, exposing cartridges 26*a*, 26*b* to external pressure significant enough to collapse them and force additives within the cartridges towards primary fluid channel 24. Rotational fluid control switch 14 may be equipped with an illumination feature to assist in controlling alternative features of the embodiment.

Removable threaded cap 12 allows access into the rear compartment of vessel 11.

In another embodiment of the present invention multiple replaceable enrichment cartridges 26 that fasten to stationary partition 25 comprise a plurality of separate and smaller diameter fluid passages 27 that provide a conduit through stationary partition 25, thereby connecting the rear compartment and front compartment of vessel 11 in fluid communication for combined fluids issuing the nozzle end. A junction is formed between the inlet passage where cartridges 26*a*, 26*b* fasten to stationary partition 25 and the smaller diameter fluid passages 27 that ultimately connects to fluid supply line 28 where there rotatable adjustable fluid control switches 17*a*, 17*b* are positioned.

Figure 5A:
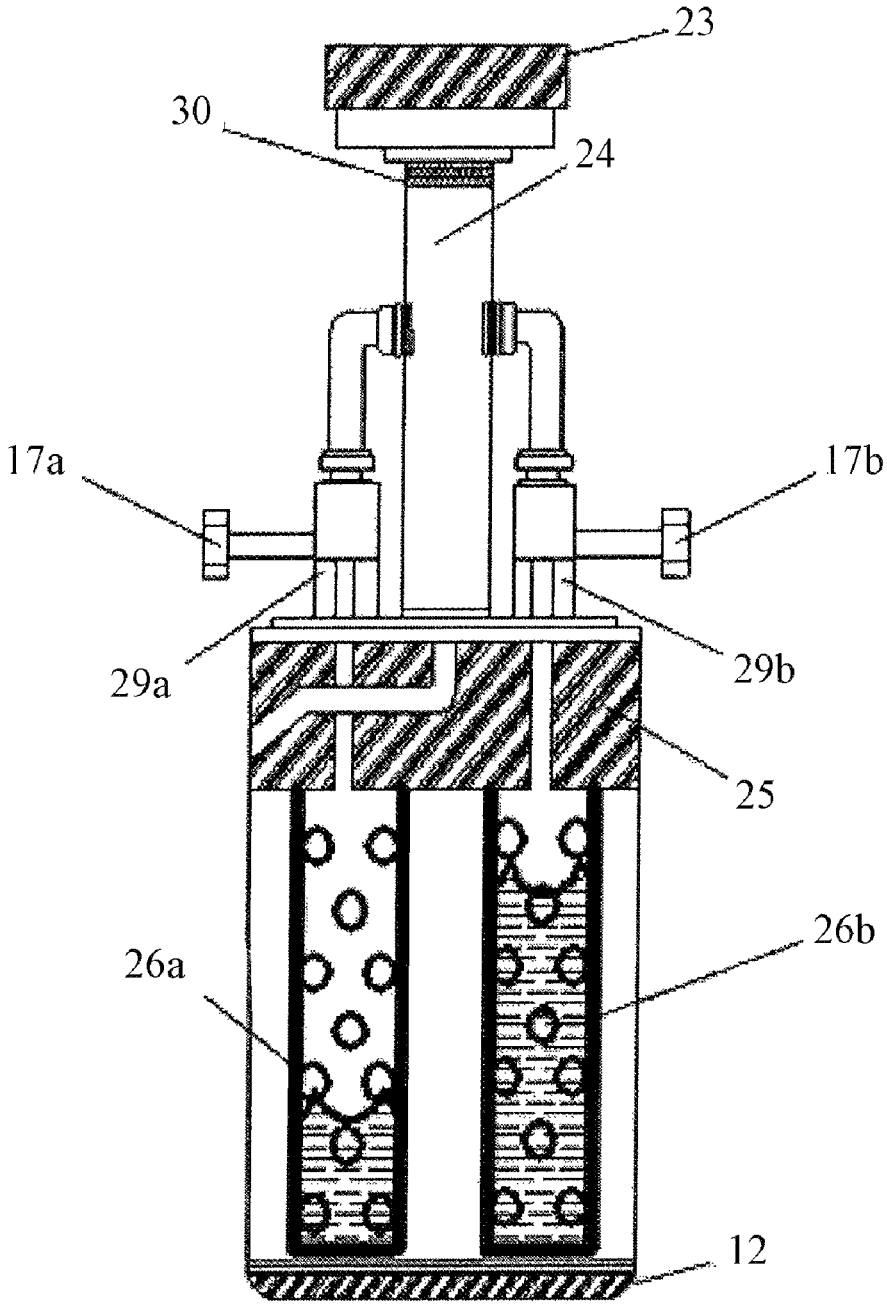
FIG. 5A is a cross-sectional view of one embodiment of an applicator depicting internal fluid flow passages and cartridges in a non-pressurized state.

FIG. 5A depicts a cross-sectional view of applicator 10 when cartridges 26*a*, 26*b* are not under pressure, insomuch as ingress fluid has not entered the chamber segregated by partition 25. The collapsible, replaceable cartridges 26*a*, 26*b* are shown in a non-collapsed, steady-state condition, with varying amount of additives or enrichments in them. The cartridges can be sealed in non-refillable, collapsible containers. The fluids issuing each of the separate cartridges exit fluid passages 27*a*, 27*b* that are in fluid communication with associated fluid control valves 29*a*, 29*b*, respectively, which connect to separate enrichment control switches 17*a*, 17*b*. Each enrichment control switch 17*a*, 17*b* operates separately for the dispensing of enrichments from cartridges 26*a*, 26*b*. Mechanical mixers or turbines 30 may be present at the exit end of primary fluid channel 24 to combine the enrichments issuing the primary fluid channel 24 to applicator head nozzle 23.

Figure 5B:
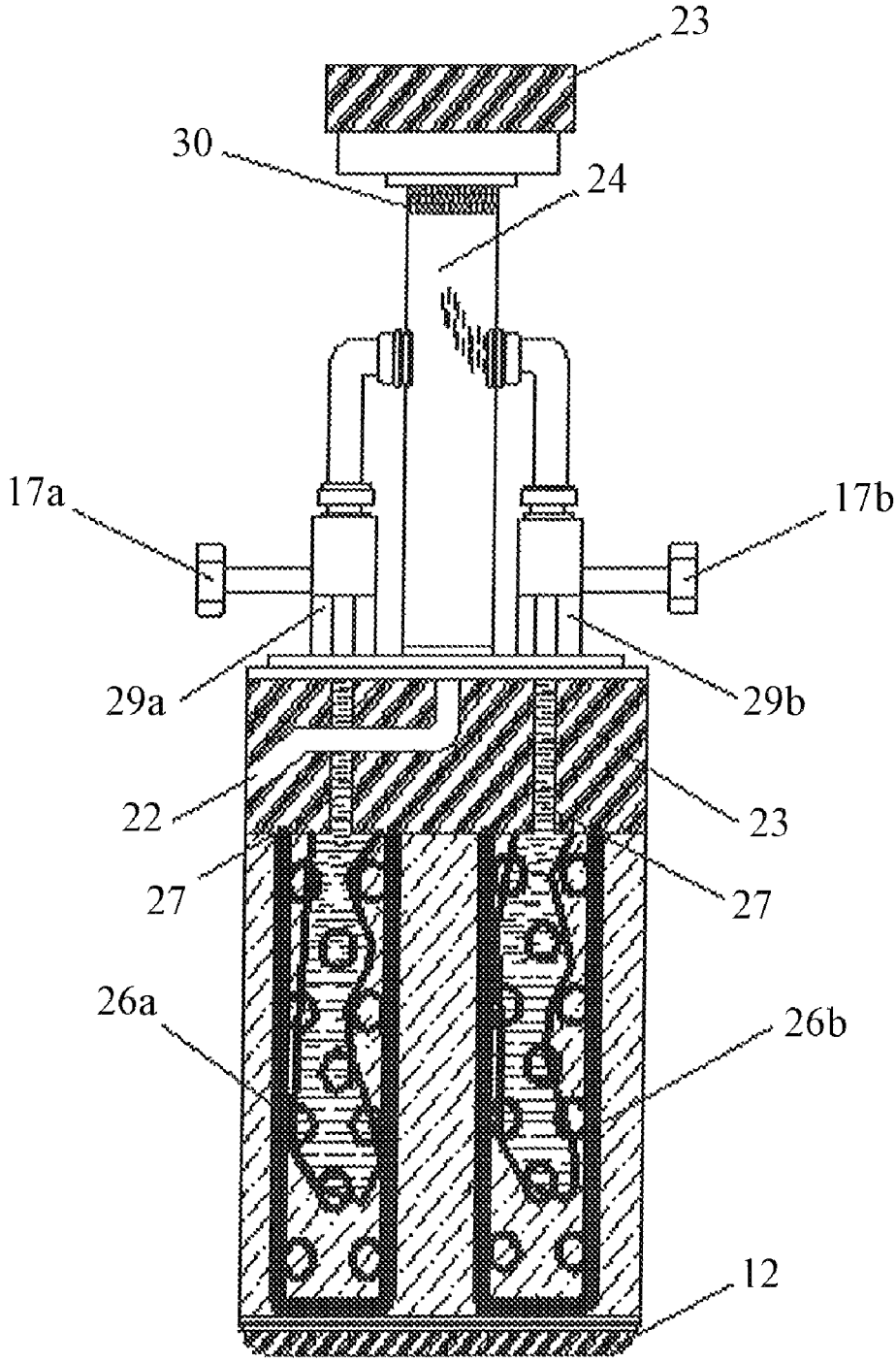
FIG. 5B is a cross-sectional view of the applicator of FIG. 5A depicting internal fluid flow passages and cartridges in a pressurized state.

FIG. 5B depicts a cross-sectional view of applicator 10 when cartridges 26*a*, 26*b* are under external pressure insomuch as ingress fluid has entered the chamber segregated by partition 25, and has put external, collapsible pressure on each cartridge. By collapsing cartridges 26*a*, 26*b*, additives are injected towards primary fluid channel 24, but may be adjusted, controlled, or prohibited from combining, with the ingress fluid from fluid channel 21*a* by appropriate selection of fluid control switches 17*a*, 17*b*, respectively.

Figure 6A:
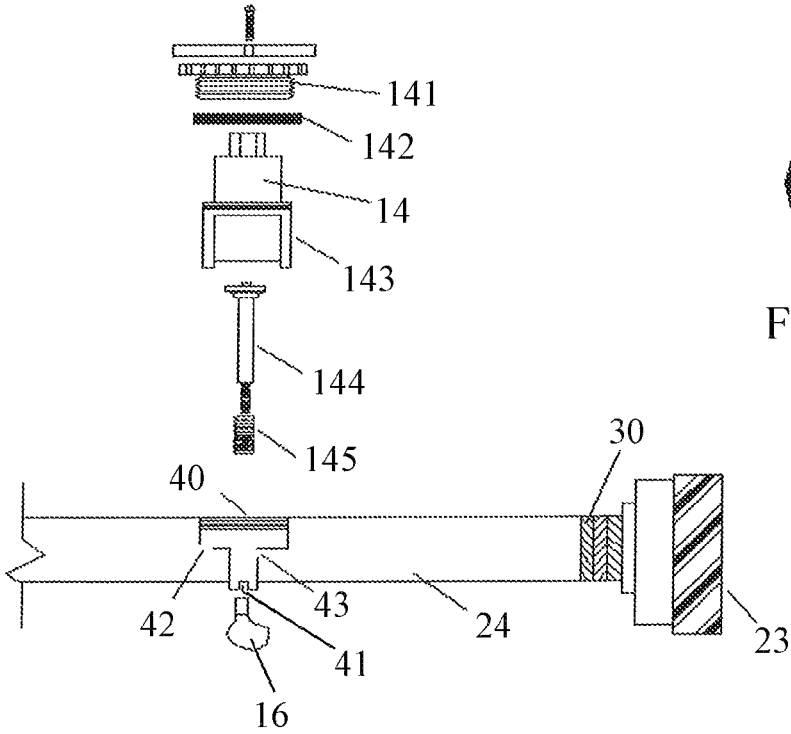
FIG. 6A is an assembly side view of a rotational fluid control switch and trigger mechanism.

FIG. 6A shows a partial cross-sectional view of the salient features of another embodiment of the present invention where rotational fluid control valve 14 and front trigger mechanism 16 are coupled on opposite sides of primary fluid channel 24 whereby trigger mechanism 16 and rotational fluid control switch 14 may function singularly or in combination with each other to substantially facilitate separate fluid flow operations. Rotational fluid control switch 14 may be attach to a threaded orifice 40 in primary fluid channel 24 with trigger mechanism 16 attaching on the opposite side at location 41. The position of rotational adjustable fluid control switch 14 regulates the metering and pressurization of fluids entering a predetermined orifice 42 in primary fluid channel 24 that then exits a second predetermined orifice 43 whereby the exiting fluids are substantially combined issuing mechanical turbines 30 before ultimate egress at applicator head nozzle 23.

Figure 6B:
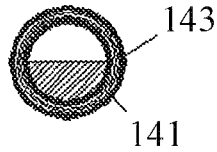
FIG. 6B depicts an expanded view of the valve body of the rotational fluid control switch of FIG. 6A.

Rotational fluid control switch 14 comprises a threaded cap 141 for threaded attachment to threaded orifice 40, forming a fluid-tight seal using washer 142 to encompass valve body 143, threaded spindle 144, and resilient retention spring 145 within primary fluid channel 24. FIG. 6B depicts an expanded view of valve body 143 of rotational fluid control switch 14. The opening in valve body 143 is shown as a semi-circle, with half of the opening blocked with valve body material. In this manner, rotation of valve body 143 will regulate fluid flow.

Figure 7:
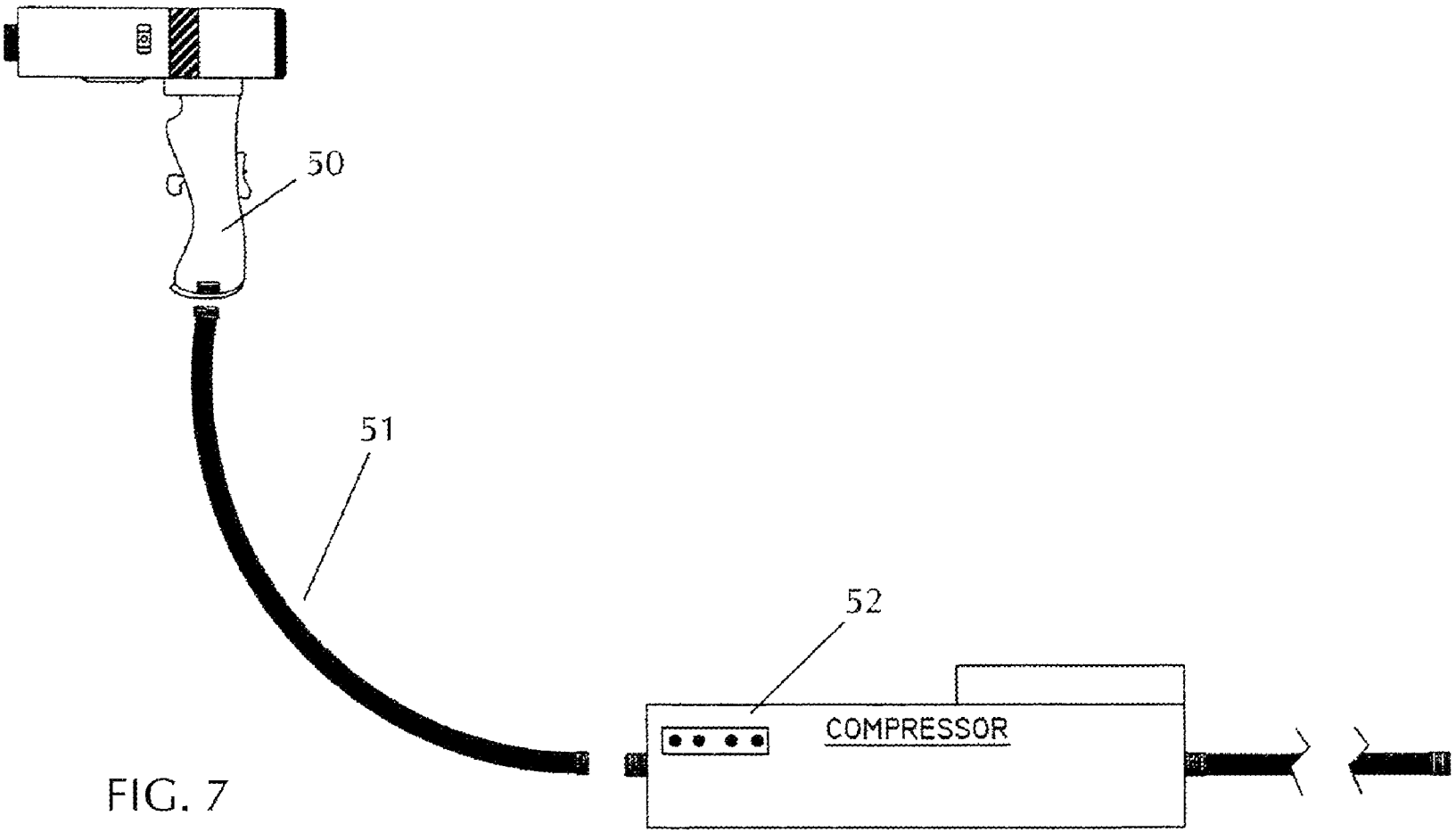
FIG. 7 is a side view of an applicator of the present invention attached to a compressor

FIG. 7 is a side view of an applicator 50 of the present invention attached to a compressor 52. Compressor 52 represents a source of power whereby applicator 50 attached to hose 51 could be connected to compressor 52 in a manner that promotes a high pressure fluid environment, which eliminates the need for more expensive pressurized applicators. The rated water pressure in pounds per square inch (psi) for the applicator is not designed to exceed the vessel's design limit, and could be substantially rated to provide about the same or adequate pressure for generally suitable tasks where excessively high pressure would not provide a substantially larger advantage for the stated increase.

When an applicator of the present invention is attached to a fluid source, for example a water hose or the like, and trigger mechanism 16 is activated, the ingress fluid enters fluid channels in handgrip 13 and is divided into two paths. In the first fluid channel 21*a*, the ingress fluid flows in a direction through handgrip 13 to primary fluid channel 24 and ultimately continues to the applicator's egress, applicator nozzle head 23. In the second fluid channel 21*b*, ingress fluid is regulated by rotational fluid control switch 14, which limits the amount of ingress fluid traversing through fluid channel 21*b*. The operator may preselect this regulation. Ingress fluid traversing fluid channel 21*b* pressurizes vessel 11 behind partition 25, and collapses additive cartridges 26*a*, 26*b*. Subjected to this external force, additives within cartridges 26*a*, 26*b* are ejected to fluid control valves 29*a*, 29*b*. Each cartridge may hold a different additive product. At this point, the operator may select which additive or combination of additives is desired for delivery by the applicator. The operator selects enrichment control switches 17*a*, 17*b* to either allow or deny egress of particular additives into primary fluid channel 24 and ultimately through applicator nozzle head 23. Once the additives are delivered to primary fluid channel 24, they are combined with the ingress fluid from first fluid channel 21*a*. Mechanical mixers or turbines 30 located near or at applicator nozzle head 23 mix the additives with the fluid in primary fluid channel 24 before the combination exits applicator nozzle head 23.

As an illustrative example, the process of mixing chemicals or solvents with water using an applicator of the present invention includes: a) providing pressurized water through a threaded coupling for a hose attachment; b) allowing ingress water to flow to primary fluid channel 24 by toggling trigger mechanism 16; c) adjusting fluid ingress to the cartridge compartment of vessel 11 by rotating rotational fluid control valve 14 to a desired selection; d) selecting one or more additives to combine with water in primary fluid channel 24 by activating enrichment fluid control switches 17*a*, 17*b*; and e) adjusting applicator nozzle head 23 for dispensing the combined water/additive mixture.

Unlike Venturi operated hose attachments, the present invention does not work on the principle of vacuum Venturi technology or gravity. Beneficially for proper function and maintenance, there are no moving parts or limitations on the angle required for operation. The present invention is designed to work in a radius of 360 degrees, and in diverse mediums, including under water. Advantageously, the operator decides the rate of flow, product volume, and applied water pressure.

With replaceable cartridges, the present invention allows the operator easily to change additives, which provides versatility not realized in the prior art. For instance, it is possible, with the simple change of additive cartridges, to first wash and wax a car, and then fertilize and weed control a garden, and then disinfect all your garden tool and machinery. Furthermore, with a plurality of cartridges in the vessel at one time, all of these operations can be performed with the single handheld applicator of the present invention without having to open the applicator or remove cartridges or the ingress water hose.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An applicator for dispensing at least one additive in a fluid system comprising:

a vessel having a first portion for receiving fluid under pressure, and a second portion for mixing and dispensing said at least one additive;

at least one cartridge in said first portion of said vessel, and in fluid communication with said fluid, said at least one cartridge including an outer shell having at least one aperture for fluid ingress, and a collapsible, fluid-tight liner containing said at least one additive, said at least one cartridge collapsively responsive to an increase in externally applied pressure from said fluid, such that when said at least one cartridge is subjected to said externally applied pressure, said at least one cartridge compresses, dispensing said at least one additive from said first portion of said vessel to said second portion of said vessel;

a primary fluid channel in said second portion of said vessel in fluid communication with said at least one cartridge and said fluid, receiving said at least one additive upon compression of said at least one cartridge, combining said fluid and said at least one additive;

a variable switch or valve for regulating the introduction of said at least one additive to said primary fluid channel allowing an operator to mix different additives in various amounts when more than one additive is present;

a variable switch or valve for regulating egress fluid from said vessel;

a variable switch or valve for regulating ingress fluid pressure on said at least one cartridge; and a nozzle in fluid communication with said primary fluid channel receiving and dispensing said combined fluid and said at least one additive.

2. The applicator of claim 1 including a handgrip attached to said vessel for making said applicator hand holdable during operation.

3. The applicator of claim 1 including a partition between said first portion and said second portion of said vessel, said partition having mechanical strength to maintain pressure within said first portion of said vessel including at least one channel to allow said at least one additive to dispense to said second portion of said vessel.

4. The applicator of claim 1 including a mixer located downstream from the introduction of said at least one additive with said fluid, said mixer providing further combination of said at least one additive with said fluid.

5. The applicator of claim 1 including a trigger mechanism for starting and stopping fluid ingress to said vessel first portion, second portion, or both.

6. The applicator of claim 2 wherein said handgrip includes fluid channels for directing ingress fluid separately towards said vessel first portion and said vessel second portion.

* * * * *